US007810175B2

(12) United States Patent
Chiang

(10) Patent No.: US 7,810,175 B2
(45) Date of Patent: Oct. 12, 2010

(54) SWIMMING GOGGLES

(76) Inventor: Herman Chiang, 11F-2, No. 634-9, Ching-Ping Rd., Chung-Ho City, Taipei Hsien (TW)

( * ) Notice: Subject to any disclaimer, the term of this patent is extended or adjusted under 35 U.S.C. 154(b) by 608 days.

(21) Appl. No.: 11/851,725

(22) Filed: Sep. 7, 2007

(65) Prior Publication Data

US 2009/0038062 A1 Feb. 12, 2009

(51) Int. Cl.
*A61F 9/02* (2006.01)

(52) U.S. Cl. ..... 2/448

(58) Field of Classification Search ..... 2/428, 2/443, 448, 445, 452; 351/43
See application file for complete search history.

(56) References Cited

U.S. PATENT DOCUMENTS 6,560,788 B1 * 5/2003 Beltrani ..... 2/428
6,832,394 B1 * 12/2004 Chiang ..... 2/428
6,961,965 B2 * 11/2005 Chiang ..... 2/445
7,251,842 B1 * 8/2007 Chiang ..... 2/445
7,631,400 B2 * 12/2009 Chiang ..... 24/170

* cited by examiner

*Primary Examiner*—Katherine Moran
(74) *Attorney, Agent, or Firm*—Rosenberg, Klein & Lee

(57) ABSTRACT

Swimming goggles have a left frame and a right frame respectively receiving lenses therein, a connecting bridge between the left frame and the right frame, a head strap, and buckles for supporting the head strap. Each buckle comprises an assembling frame and a strap frame pivotably assembled to each other. The assembling frame includes a pivoting shaft, an abutting arm extending from the pivoting shaft, and a resilient arm extending from the pivoting shaft and opposite to the abutting arm. Branches respectively extend from opposite sides of the resilient arm. A first controlling arm and a second controlling arm are formed on outward sides of the assembling frame and adjacent to the branches for controlling the branches. The strap frame defines a pivoting orifice for pivoting to the pivoting shaft, and a guiding hole for guiding the head strap. The head strap is operated by a couple of fingers, making manual operation ergonomic.

14 Claims, 9 Drawing Sheets

SWIMMING GOGGLES

BACKGROUND OF THE INVENTION

1. Field of the Invention

The present invention relates to swimming goggles, and particularly to swimming goggles which have an adjustable head strap and are conveniently used.

2. Related Art

Swimming goggles typically have adjusting buckles for positioning a head strap at desired length. Some adjusting buckles are capable of stopping the head strap, while other adjusting buckles are incapable of stopping the head strap. The first type of adjusting buckles, which are incapable of stopping the head strap, may adjust the head strap bi-directionally at random. The swimming goggles with the first type of adjusting buckles, however, have to be taken up and down frequently for adjusting the head strap, which is troublesome. The second type of adjusting buckles, which are capable of stopping the head strap, may freely adjust the head strap bi-directionally and stop the head strap in a single direction without need of taking swimming goggles up and down. So the swimming goggles with the second type of adjusting buckles are used more conveniently.

The swimming goggles with adjusting buckles capable of stopping the head strap are disclosed in some patents, for example, Taiwan patent Nos. 93208471, 94203155, 94203156 (which respectively correspond to U.S. patent application Ser. Nos. 10/873,260, 11/092,927, 11/092,929). The adjusting buckles of the swimming goggles in these patents release the head strap by pressing a button with a single finger. These designs simplify adjusting of the head strap, but cannot be utilized easily because of manual operation of a single finger.

SUMMARY OF THE INVENTION

In view of the foregoing, an object of the present invention is to provide swimming goggles which adjust a head strap by a couple of fingers, thereby being operated easily and ergonomically.

The swimming goggles comprise a left frame, a right frame, a connecting bridge between the left frame and the right frame, lenses respectively received in the left frame and the right frame, a head strap with a plurality of abutting grooves therein, and buckles for supporting the head strap. Each buckle comprises an assembling frame and a strap frame pivotably assembled to each other. The assembling frame is disposed on outward sides of the left frame or the right frame, and includes a pivoting shaft, an abutting arm transversely extending from the pivoting shaft, and a resilient arm extending from the pivoting shaft and opposite to the abutting arm. Branches respectively extend from opposite sides of the resilient arm. A first controlling arm and a second controlling arm are formed on outward sides of the assembling frame and adjacent to the branches for controlling the branches. The strap frame defines a pivoting orifice for pivoting to the pivoting shaft, and a guiding hole for guiding the head strap. The abutting arm abuts against the abutting grooves of the head strap. When the first and the second controlling arms are pressed facing each other, the branches deform to bend as an arch toward the resilient arm. The abutting arm displaces in a direction reverse to the branches, such that the abutting arm departs from the abutting groove of the head strap to loosen the head strap.

The strap frame of each buckle includes a first fixing portion. Second fixing portions are formed on the left frame and right frame for locking with the first fixing portions. In one embodiment, the first fixing portion of each buckle comprises a U-shaped slot formed on the strap frame. The second fixing portions comprise T-shaped latches respectively formed on the left frame and right frame for locking with the U-shaped slots.

The branches substantially form an arched shape, and further bend towards the resilient arm when deformed. The branches are thinner than the resilient arm for providing sensitivity of bending when deformed.

DESCRIPTION OF THE PREFERRED EMBODIMENTS

Figure 1:
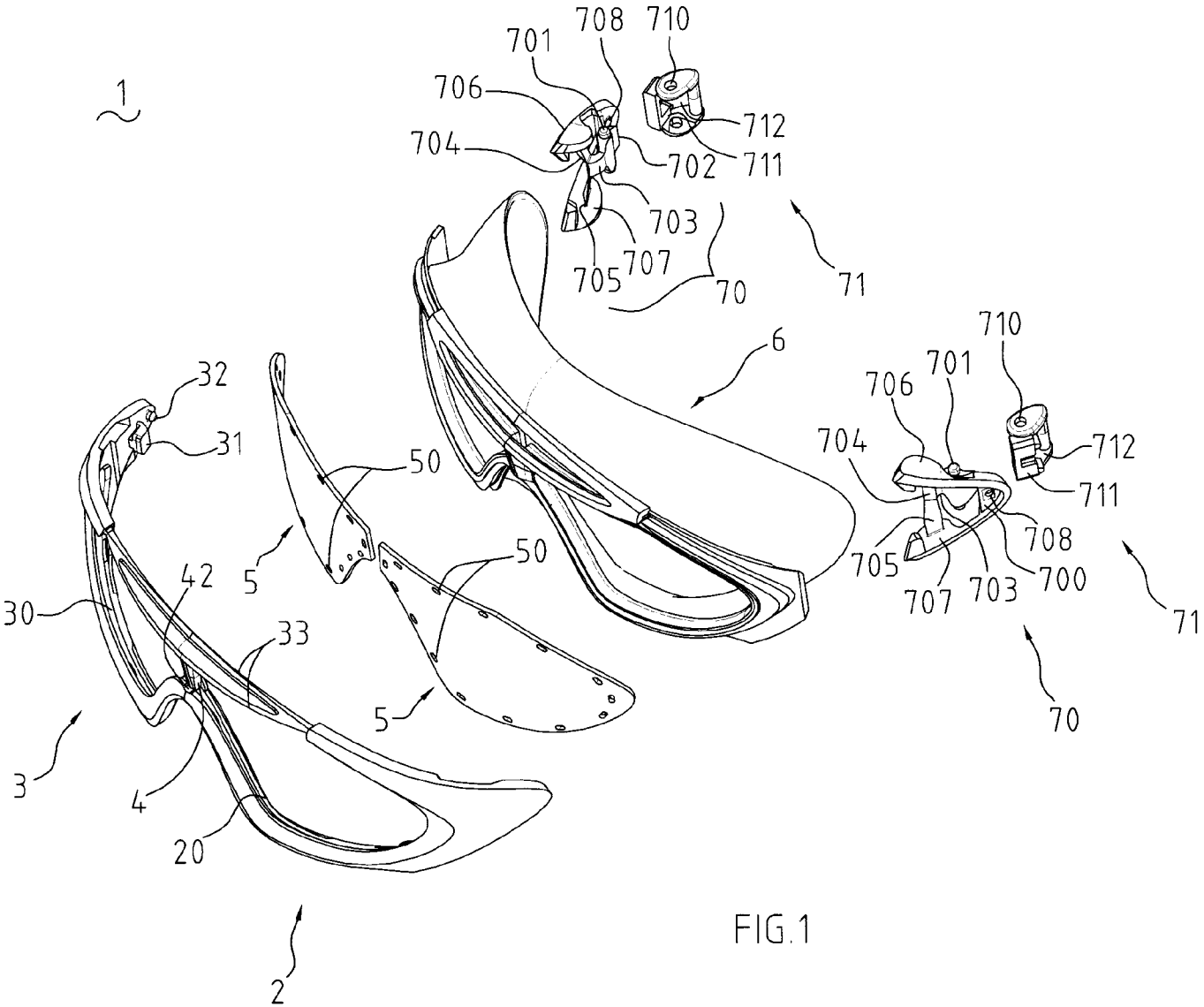
FIG. 1 is an exploded view of swimming goggles of the present invention.
Figure 2:
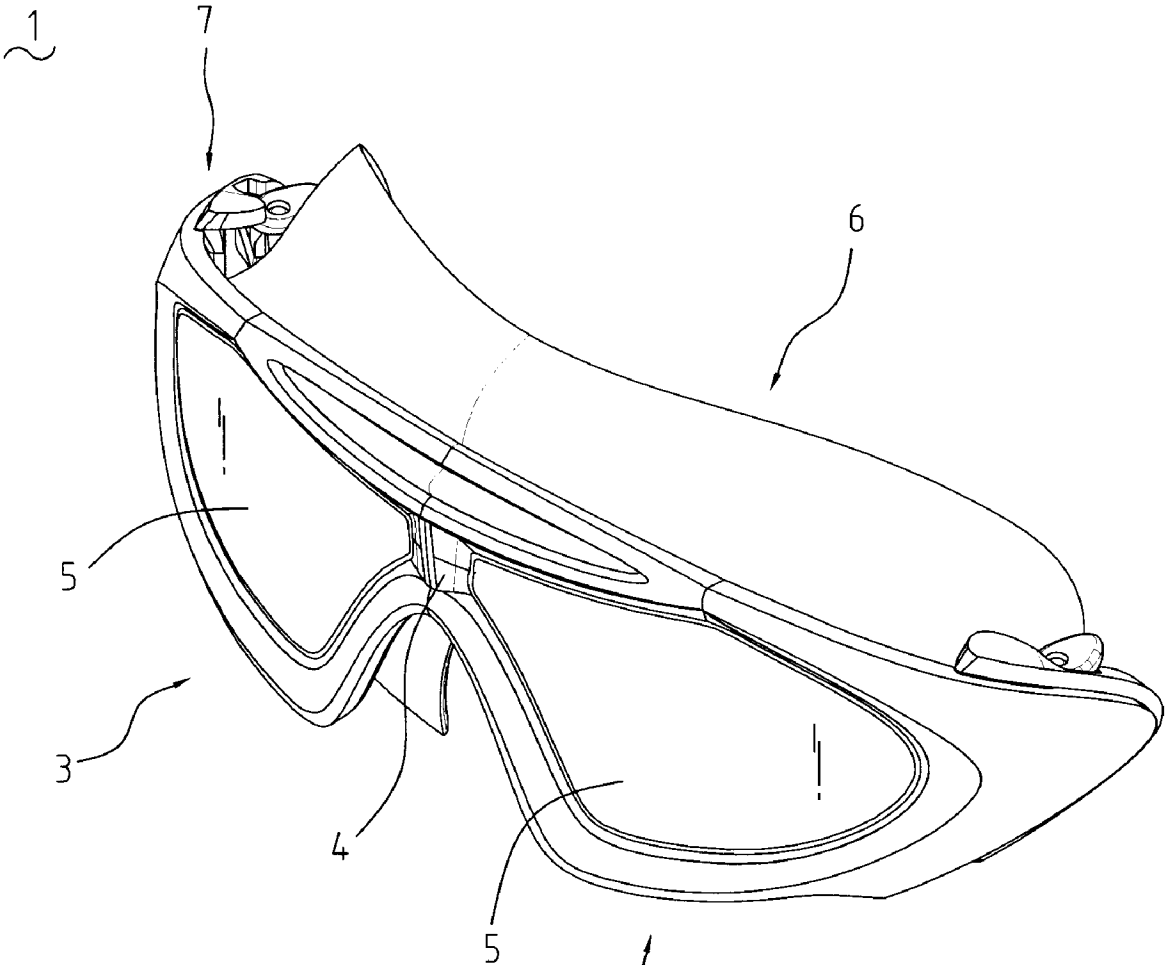
FIG. 2 is a perspective view of the swimming goggles of FIG. 1.
Figure 3:
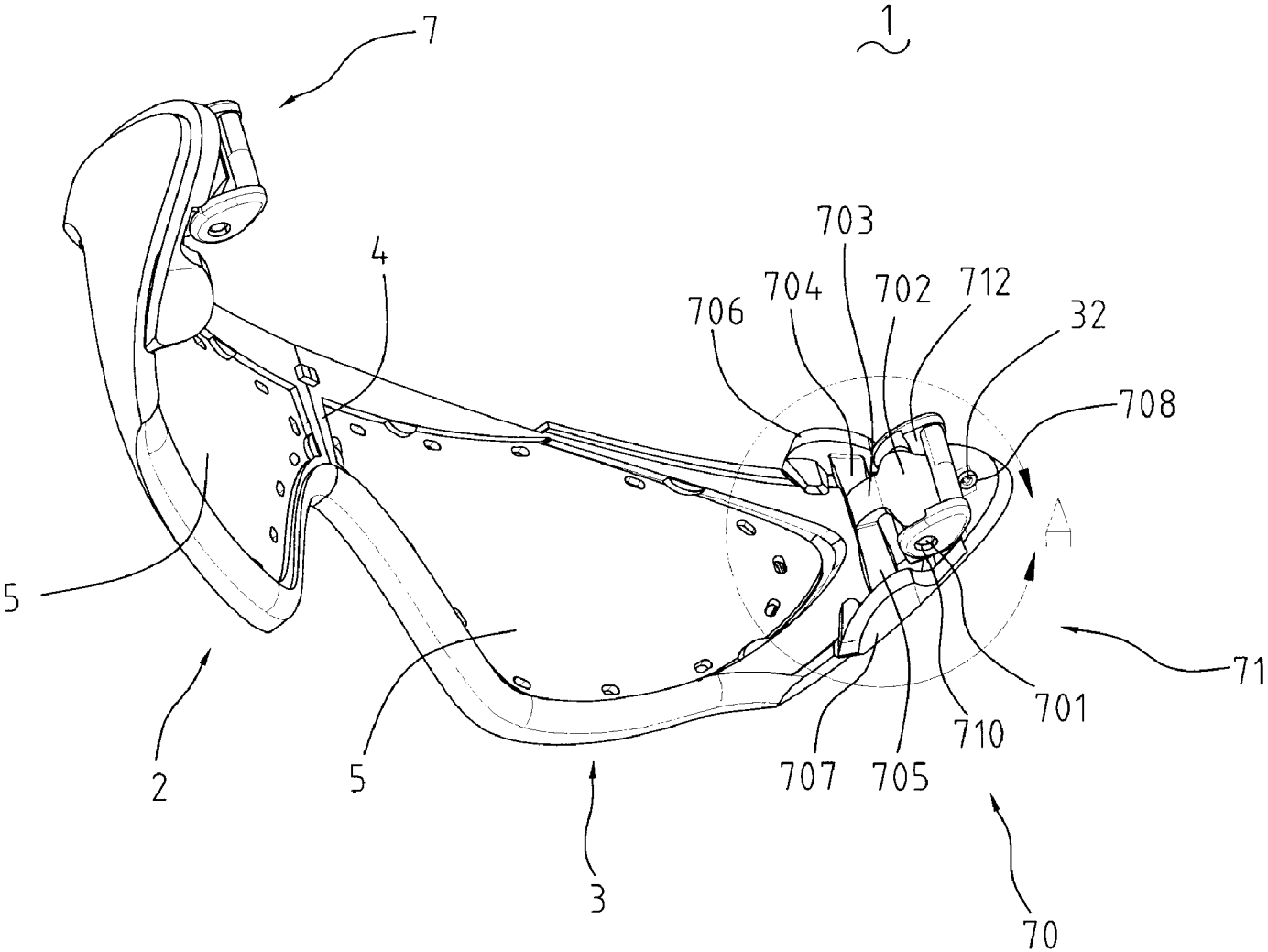
FIG. 3 is a perspective view of swimming goggles of the present invention from a rear aspect, wherein a pad is removed for being clearly shown.
Figure 4:
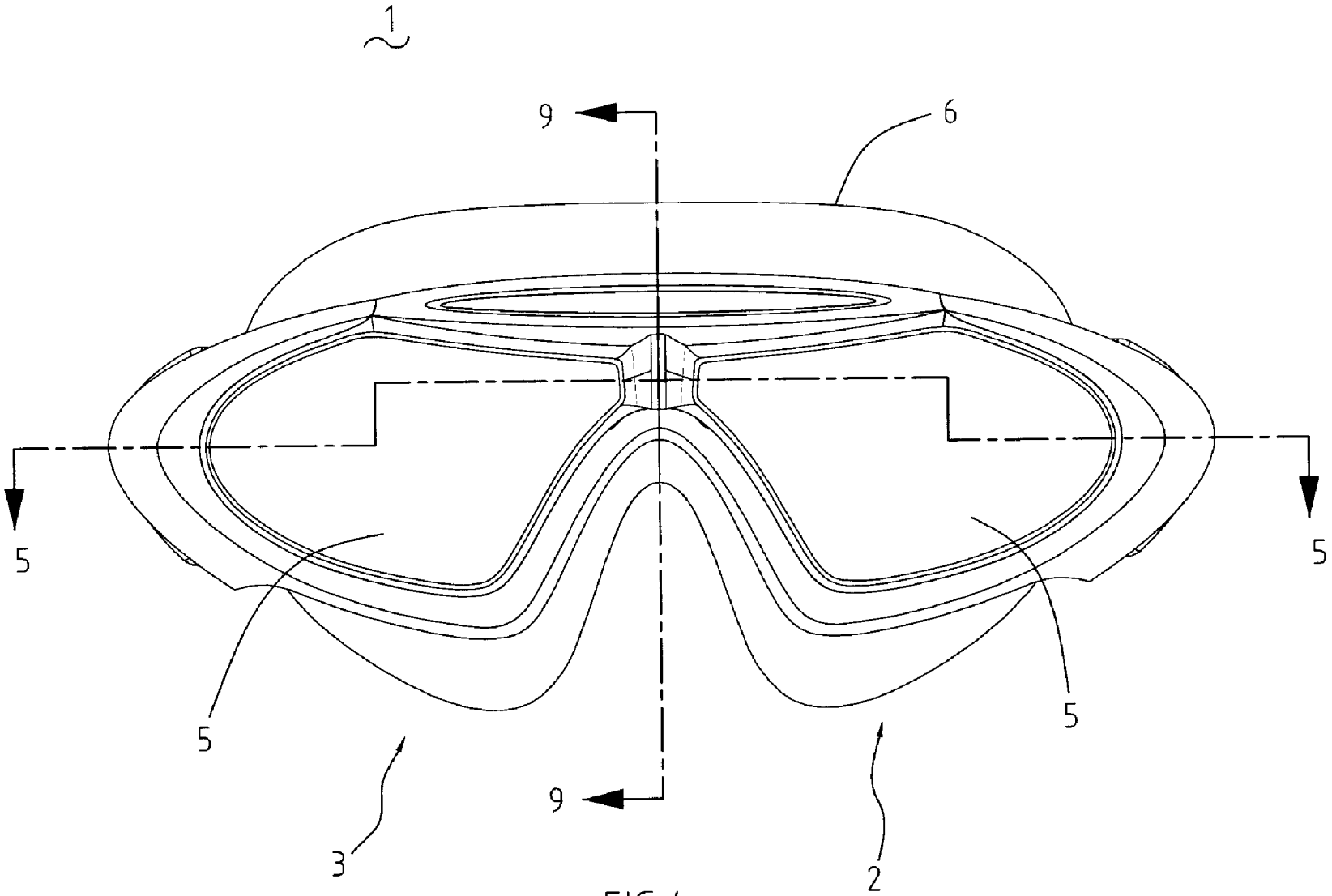
FIG. 4 is a front view of the swimming goggles of FIG. 2.
Figure 5:
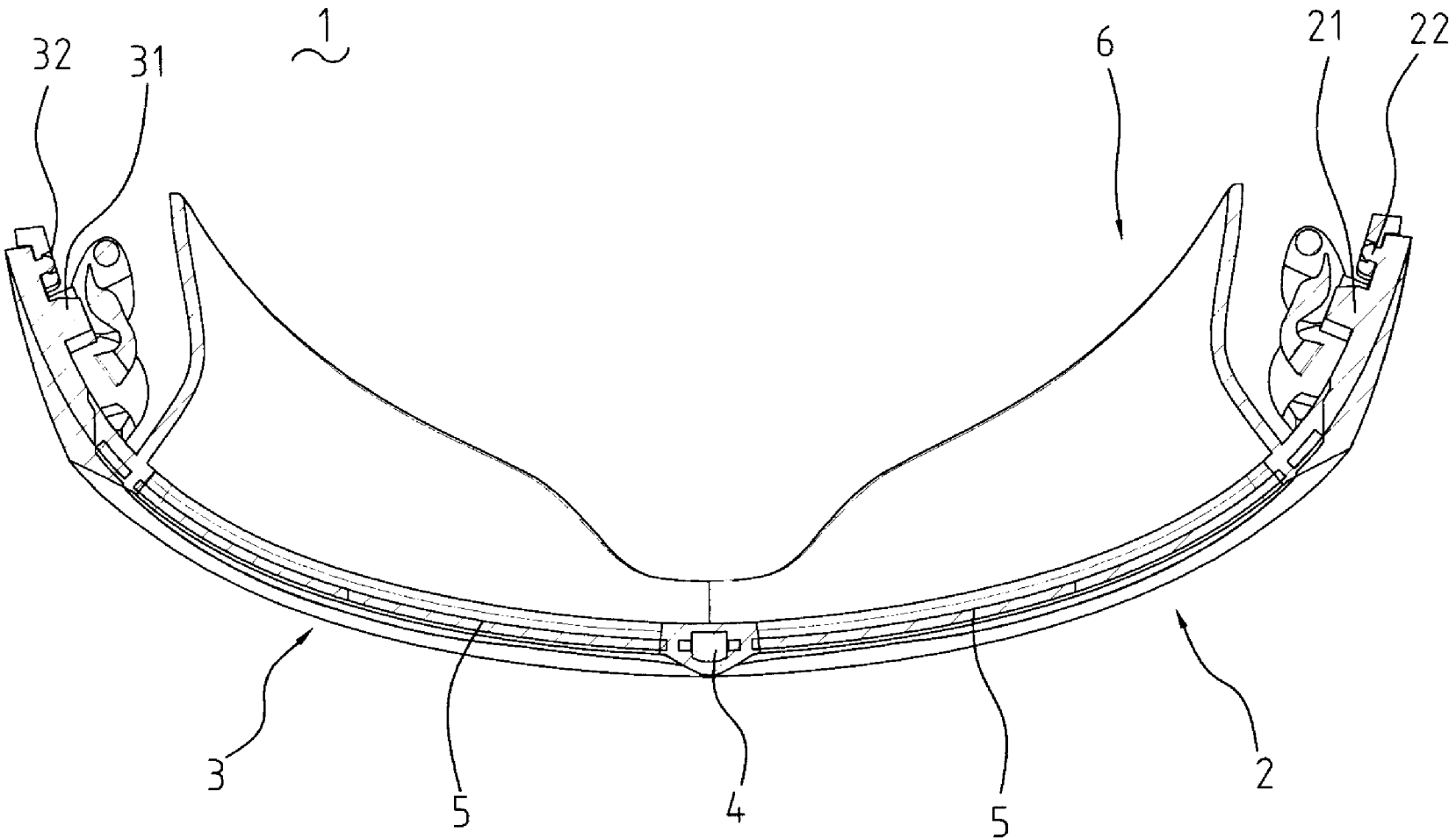
FIG. 5 is a cross-sectional view taken along the line 5-5 in FIG. 4.
Figure 6:
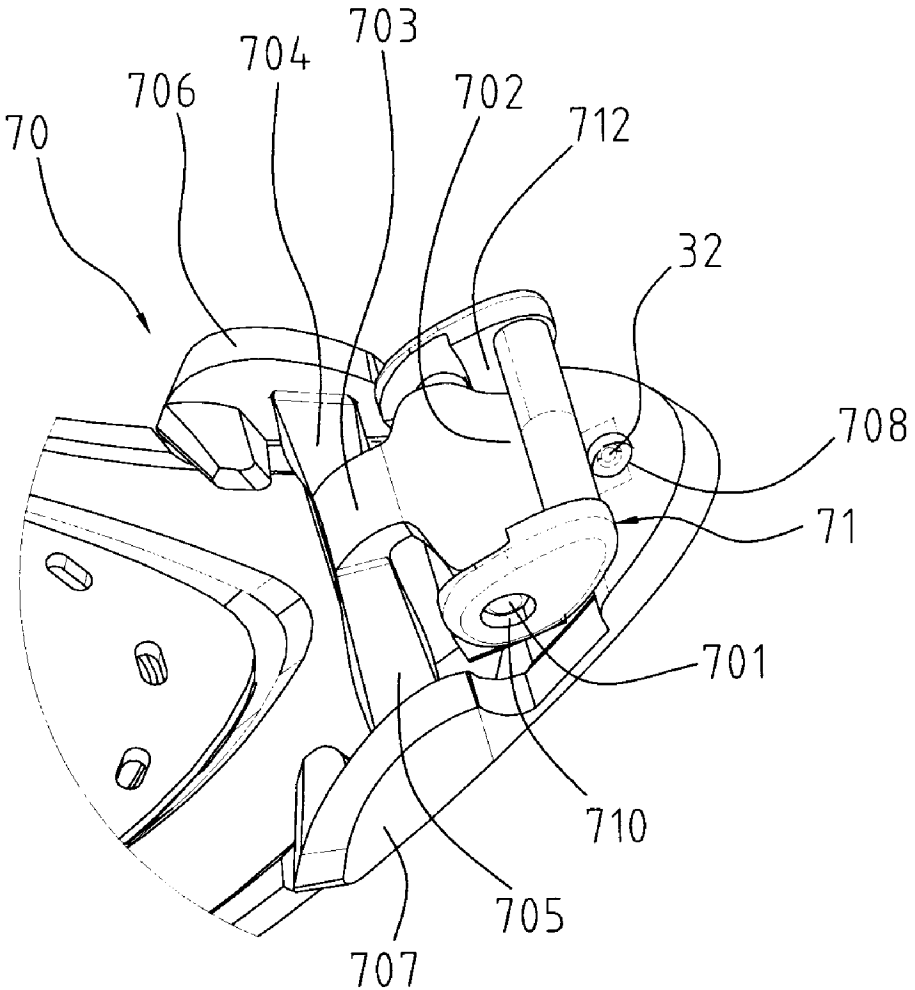
FIG. 6 is a partially enlarged view of FIG. 3.

With reference to FIGS. 1, 2 and 3, swimming goggles 1 of the present invention comprise a left frame 2, a right frame 3, a connecting bridge 4 between the left frame 2 and the right frame 3, lenses 5, a pad 6, a head strap 8, and buckles 7 for supporting the head strap 8. The left frame 2, the right frame 3 and the connecting bridge 4 are integrally made of PP material. First enveloping areas 33 are defined on upper edges of the left frame 2 and the right frame 3, and a second enveloping area 42 is defined on the connecting bridge 4 for being enveloped by the pad 6 when integrally shaping. The left frame 2 and the right frame 3 respectively have passageways 20, 30 for receiving the lenses 5. Second fixing portions are formed on outward sides of the left frame 2 and the right frame 3. In one embodiment, as shown in FIG. 5, the second fixing portions comprise T-shaped latches 21, 31 respectively formed on outward sides of the left frame 2 and the right frame 3. Locking portions are formed on the latches 21, 31, and in one embodiment, comprise hook-like posts 22, 32.

Figure 9:
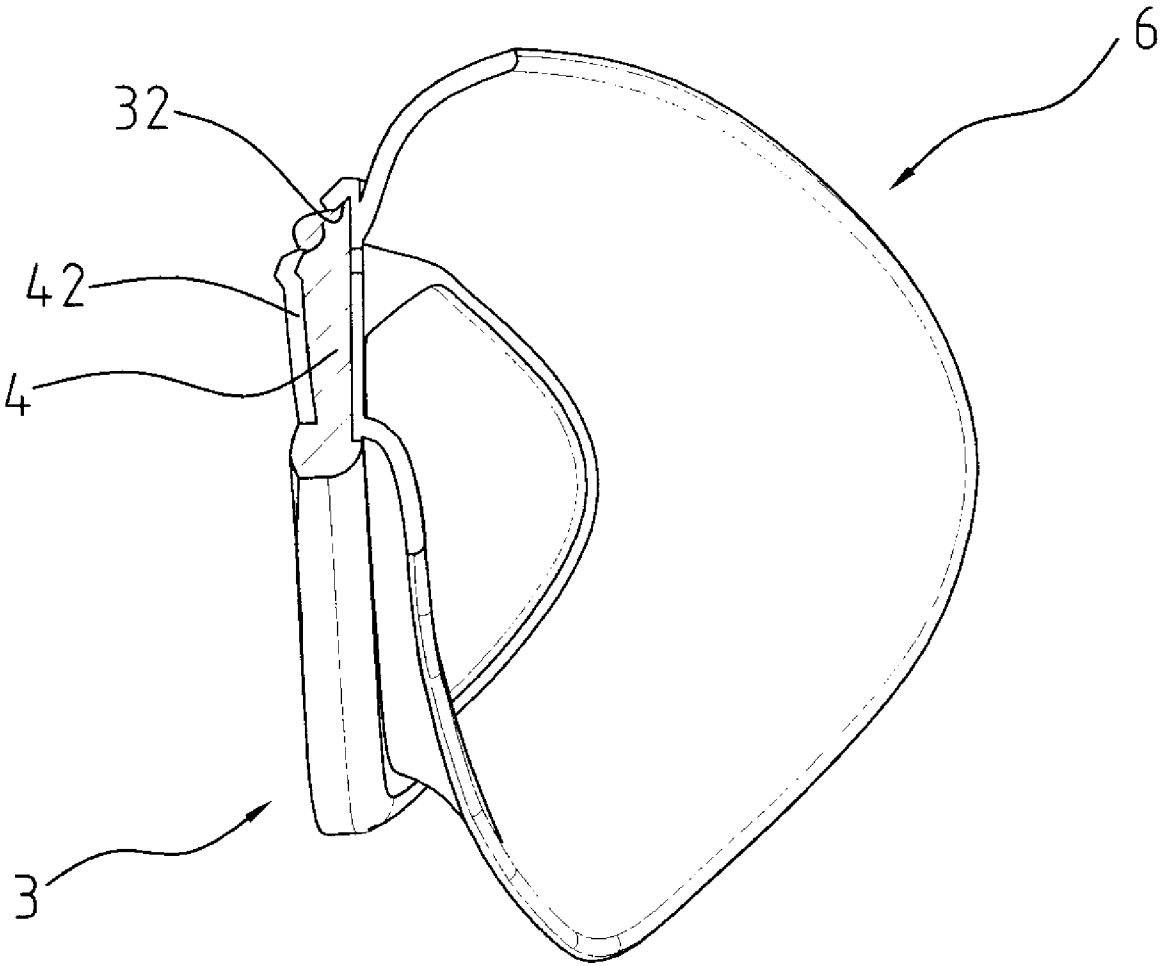
FIG. 9 is a cross-sectional view taken along the line 9-9 in FIG. 4.

The pad 6 is made of silica gel for providing comfortable touching and preventing water leakage. During manufacturing, as the lenses 5 are implanted into the passageways 20, 30, the silica gel is put through enveloping holes 50 of the lenses 5 to be attached to the first and the second enveloping areas 33, 42, and is unitarily formed with the lenses 5. Therefore the plastics of the pad 6 grasp the lenses 5 and fill the first and the second enveloping areas 33, 42, reinforcing assembly of the swimming goggles 1 (further referring to FIG. 9).

Each buckle 7 comprises an assembling frame 70 and a strap frame 71 pivoting to each other. The assembling frame 70 includes a pivoting shaft 701, an abutting arm 702 transversely extending from the pivoting shaft 701, and a resilient arm 703 extending from the pivoting shaft 701 and opposite to the abutting arm 702. Branches 704, 705 respectively extend from opposite sides of the resilient arm 703. A first controlling arm 706 and a second controlling arm 707 are respectively formed on outward sides of the assembling frame 70 and adjacent to the branches 704, 705 for controlling the branches 704, 705. Preferably, the branches 704, 705 are thinner than the resilient arm 703 for providing sensitivity of bending when deformed. In one embodiment, the branches 704, 705 are of the same length, and each of the branches 704, 705 has width increasingly thinner toward the resilient arm 703 for providing sensitivity of bending when deformed. (In another embodiment, it is assumed that the branches 704, 705 are of different length. The long branch of the branches 704, 705 has a first end approaching the resilient arm 703, and the short branch of the branches 704, 705 has a second end approaching the resilient arm 703, the first end is thinner than the second end. Thus the bent arch of the resilient arm 703 may be balanced when the resilient arm 703 is deformed.) The branches 704, 705 substantially form an arched shape, and further bend towards a particular side (toward the resilient arm 703) when deformed. The abutting arm 702 displaces about the pivoting shaft 701 in a direction reverse to the bending direction of the branches 704, 705. A first distal end of the first controlling arm 706 connects with a second distal end of the second controlling arm 707, and a first free end of the first controlling arm 706 is far away from a second free end of the second controlling arm 707. The first and the second controlling arms 706, 707 together form V shape, and therefore the first and the second free ends of the first and the second controlling arms 706, 707 make manual operation convenient. A link portion is formed adjacent the connected ends of the first and the second controlling arms 706, 707. The link portions respectively latch the locking portions of the left frame 2 and the right frame 3 for fixing the assembling frames 70 onto the left frame 2 and the right frame 3. In one embodiment, the link portion includes a flat 700 on the assembling frame 70, a positioning orifice 708 being defined in the flat 700. The hook-like posts 22, 32 of the left frame 2 and the right frame 3 latch with the positioning orifices 708. Therefore the assembling frames 70 are retained to outward sides of the left frame 2 and the right frame 3.

Figure 8:
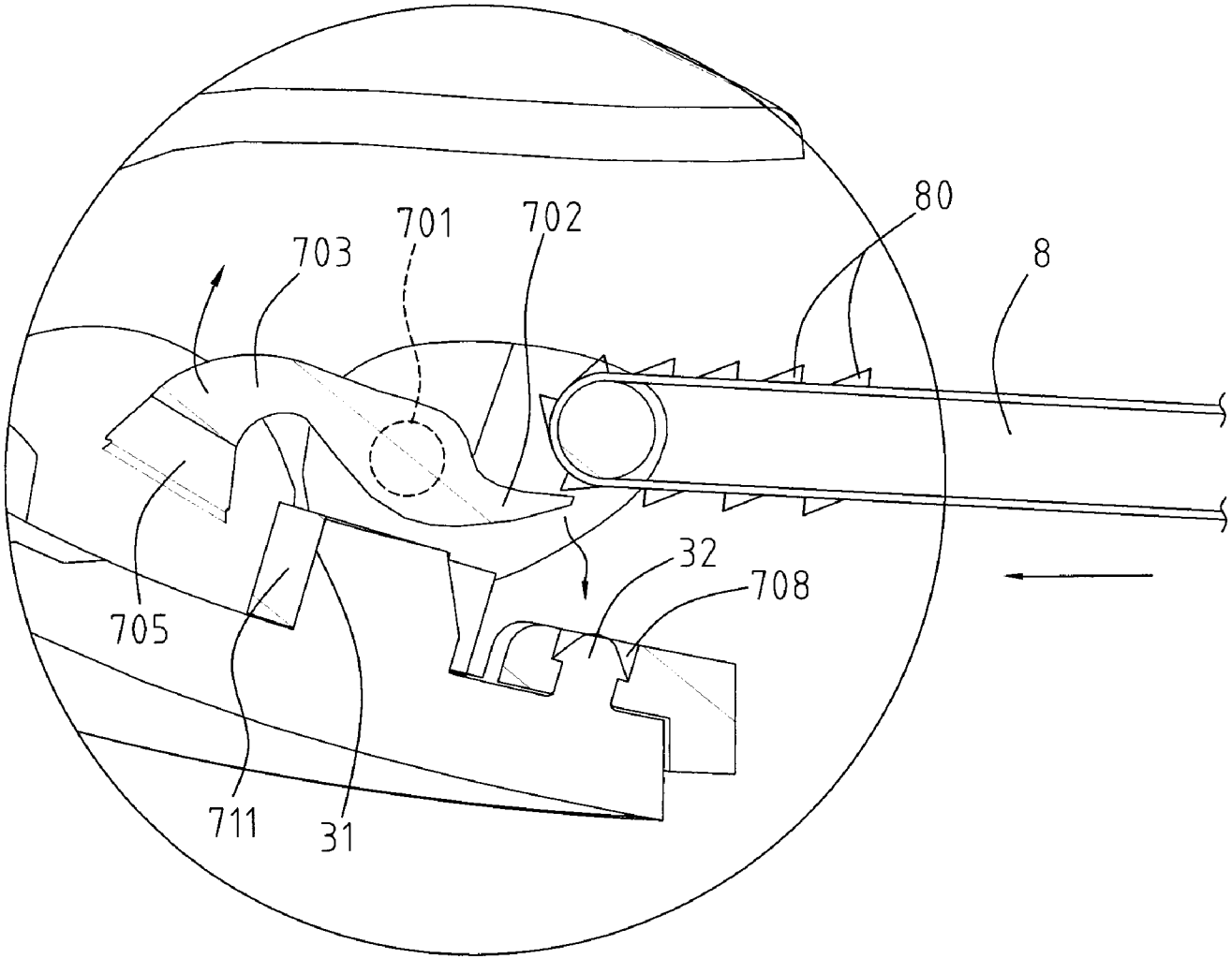
FIG. 8 is a front view of FIG. 7 and schematically shows adjusting of the head strap.

The strap frame 71 defines a pivoting orifice 710 for assembling to the pivoting shaft 701. The strap frame 71 includes a first fixing portion for assembling with the second fixing portion of the left frame 2 or the right frame 3. In one embodiment, the first fixing portion comprises a U-shaped slot 711 formed on the strap frame 71 respectively for locking with the T-shaped latches 21, 31 of the left frame 2 and right frame 3. Furthermore, the hook-like posts 22, 32 engage with the positioning orifices 708. Thus the assembling frame 70 and the strap frame 71 together form triangle shape for reliable fixation. The strap frame 71 defines a guiding hole 712 for guiding the head strap 8, as shown in FIG. 8. The head strap 8 has abutting grooves 80 for abutting against the abutting arm 702.

Figure 7:
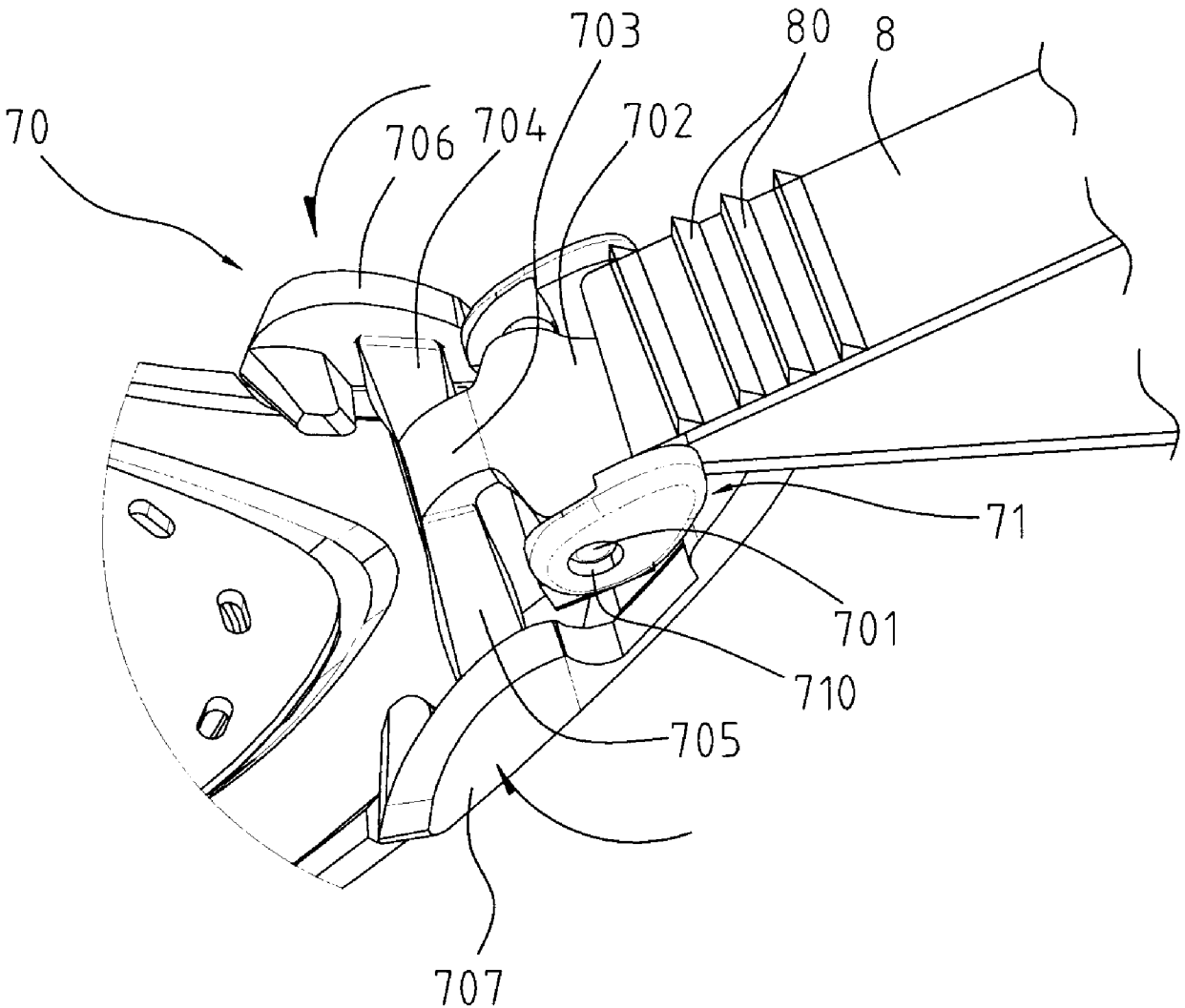
FIG. 7 is similar to FIG. 6, wherein a head strap is assembled thereto.

Further referring to FIGS. 4 to 8, in normal state, the abutting arm 702 abut against the abutting groove 80. The head strap 8 is only able to tighten. In order to loosen the head strap 8, as shown in FIGS. 7 and 8, the first and the second controlling arms 706, 707 are pressed facing each other in direction of arrows in FIG. 7. The branches 704, 705 deform, and bend as an arch toward the resilient arm 703. The abutting arm 702 displaces in a direction reverse to the branches 704, 705. With referent to FIG. 8, the abutting arm 702 departs from the abutting groove 80 of the head strap 8, allowing the head strap 8 to loosen, that is, the head strap 8 is allowed to move in direction as the arrow shown in FIG. 8. Two fingers press the first and the second controlling arms 706, 707 to disengage the abutting arm 702 from the abutting groove 80, making the manual operation facile and ergonomic.

It is notably that, when the two fingers disengage from the first and the second controlling arms 706, 707, owing to preserved energy of the deformed branches 704, 705, the abutting arm 702 returns to engage with the abutting groove 80. Meanwhile the head strap 8 is only permitted to tighten. The users can adjust the head strap 8 appropriately by a couple of fingers.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. Swimming goggles comprising a left frame, a right frame, a connecting bridge between the left frame and the right frame, lenses respectively received in the left frame and the right frame, a head strap with a plurality of abutting grooves therein, and buckles for supporting the head strap, each buckle comprising:

an assembling frame disposed on an outward side of the left frame and the right frame, and including a pivoting shaft, an abutting arm transversely extending from the pivoting shaft, and a resilient arm extending from the pivoting shaft and opposite to the abutting arm, branches respectively extending from opposite sides of the resilient arm, a first and a second controlling arms being formed on outward sides of the assembling frame and adjacent to the branches for controlling the branches; and a strap frame pivotably assembled to the assembling frame, and defining a pivoting orifice for pivoting to the pivoting shaft, and a guiding hole for guiding the head strap, the abutting arm abutting against the abutting grooves of the head strap;

wherein when the first and the second controlling arms are pressed facing each other, the branches deforming to bend as an arch toward the resilient arm, the abutting arm displacing in a direction reverse to the branches such that the abutting arm departs from the abutting groove of the head strap to loosen the head strap.

2. The swimming goggles as claimed in claim 1, wherein the branches substantially form an arched shape, and further bend towards the resilient arm when deformed such that the abutting arm displaces about the pivoting shaft in a direction reverse to bending direction of the branches.

3. The swimming goggles as claimed in claim 2, wherein the branches are thinner than the resilient arm for providing sensitivity of bending when deformed.

4. The swimming goggles as claimed in claim 3, wherein the branches are of the same length, and each of the branches has width increasingly thinner toward the resilient arm for providing sensitivity of bending when deformed.

5. The swimming goggles as claimed in claim 3, wherein the branches are of different length, a long branch of the branches having a first end approaching the resilient arm, and a short branch of the branches having a second end approaching the resilient arm, the first end being thinner than the second end for providing balance when deformed.

6. The swimming goggles as claimed in claim 1, wherein the strap frame of each buckle includes a first fixing portion, and wherein second fixing portions are formed on the left frame and right frame for locking with the first fixing portions.

7. The swimming goggles as claimed in claim 6, wherein the first fixing portion of each buckle comprises a U-shaped slot formed on the strap frame, and wherein the second fixing portions comprise T-shaped latches respectively formed on the left frame and right frame for locking with the U-shaped slots.

8. The swimming goggles as claimed in claim 1, wherein a first distal end of the first controlling arm connects with a second distal end of the second controlling arm, and a first free end of the first controlling arm is far away from a second free end of the second controlling arm, the first and the second controlling arms together forming V shape, whereby the first and the second free ends of the first and the second controlling arms make manual operation convenient.

9. The swimming goggles as claimed in claim 8, wherein the assembling frame of each buckle further forms a link portion thereon, and wherein the left frame and the right frame respectively form locking portions for corresponding to the link portions, thereby fixing the assembling frames onto the left frame and the right frame.

10. The swimming goggles as claimed in claim 9, wherein each link portion includes a flat at a bottom end of the V shape of the first and the second controlling arms, a positioning orifice being defined in the flat, and wherein the locking portions include hook-like posts formed on the left frame and the right frame for locking with the positioning orifices.

11. The swimming goggles as claimed in claim 1, wherein the left frame, the right frame and the connecting bridge are integrally made of the same material.

12. The swimming goggles as claimed in claim 11, wherein first enveloping areas are defined on upper edges of the left frame and the right frame for being enveloped when integrally shaping.

13. The swimming goggles as claimed in claim 12, further comprising a pad made of material softer than the left frame and the right frame, and as the lenses are implanted into the left frame and the right frame, the pad being brought through enveloping holes of the lenses to be attached to the left frame and the right frame and to envelop the first enveloping areas, the pad grasping the lenses and filling the first enveloping areas when integrally formed, whereby the pad is reliably retained to the left frame and the right frame.

14. The swimming goggles as claimed in claim 13, wherein a second enveloping area is defined on the connecting bridge for being enveloped when integrally shaping.

* * * * *